United States Patent [19]

Hamilton

[11] 4,211,536

[45] Jul. 8, 1980

[54] POKE HOLE CLOSURE APPARATUS

[75] Inventor: Wallace Hamilton, Chagrin Falls, Ohio

[73] Assignee: McDowell-Wellman Company, Cleveland, Ohio

[21] Appl. No.: 951,337

[22] Filed: Oct. 16, 1978

[51] Int. Cl.[2] ..... C10J 3/72

[52] U.S. Cl. ..... 48/87; 137/583; 202/269; 266/271; 110/173 R

[58] Field of Search ..... 48/87; 137/583; 220/88 B; 110/173 R; 266/271, 272; 202/239, 269

[56] References Cited

U.S. PATENT DOCUMENTS

| | | | |
|---|---|---|---|
| 241,433 | 5/1881 | Simmons | 48/87 |
| 444,631 | 1/1891 | Goetz | 48/87 |
| 805,295 | 11/1905 | Hofmann | 48/87 |
| 842,135 | 1/1907 | Campion et al. | 48/87 |

FOREIGN PATENT DOCUMENTS

| | | | |
|---|---|---|---|
| 570479 | of 1945 | United Kingdom | 48/87 |

*Primary Examiner*—S. Leon Bashore
*Assistant Examiner*—Peter F. Kratz
*Attorney, Agent, or Firm*—Pearne, Gordon, Sessions, McCoy & Granger

[57] ABSTRACT

A poke hole closure assembly for a gas producer which minimizes the escape of noxious or volatile gas from the producer during a poking operation. The closure includes a block having an aperture therethrough which communicates with a poke hole in a gas producer. A closure plate is hinged to the block to block the aperture and pole hole during normal operating conditions, but is openable to enable a poker to be inserted therethrough to check the fire bed. An inert gas is delivered to a conical nozzle in the aparture to direct the gas into the poke hole, to thereby block the outward passage of noxious or volatile gas from the poke hole when the closure plate is opened. The flow of the inert gas is controlled by a valve which is opened to allow flow upon opening of the closure and is closed to block flow when the closure is sealed.

2 Claims, 2 Drawing Figures

POKE HOLE CLOSURE APPARATUS

BACKGROUND OF THE INVENTION

In the course of operating a fixed bed gas producer, it is necessary from time to time to check the condition of the fire bed. This is accomplished by inserting a steel rod through a hole in the top of the producer and pushing the rod down through the fuel bed to the top of the grate level, in which position it may be left for several minutes.

When a hole cover is opened to admit the rod, a passage is provided for the hot producer gas to escape through the hole to atmosphere, since this gas is above atmospheric pressure. The temperature of the gas within the producer is near its ignition point, and when the escaping gas meets the atmosphere, it either ignites, producing a long jet of flame, or, if it does not ignite, provides a noxious stream of tar-laden gas. This condition is somewhat reduced when the poke rod is inserted, but the gas continues to escape through the clearance between the rod and the poke hole. Not only does such an operation result in loss of producer gas during the poking operation, but it creates a hazardous situation for the operator.

SUMMARY OF THE INVENTION

This invention overcomes the foregoing problems by providing an apparatus to inhibit the escape of producer gas to the atmosphere during a poking operation and when the poke hole is closed during normal operating conditions. When the poke hole is opened, a high velocity stream of inert gas is directed downward through the poke hole, preventing escape in the reverse direction of the gas within the producer.

These objectives are attained by providing a block having an aperture therein and by attaching that block to the casing of a gas producer so that the aperture in the block is in substantial alignment with the poke hole. The block has a cover hinged thereto, which is closed during normal operating conditions. An insert is positioned within the aperture and has an opening therethrough to permit passage of the poker and has an outer conical wall spaced from an inner conical wall of the aperture. A passageway from a source of inert gas leads to the space between the conical walls and is provided with a valve which is responsive to the opening and closing of the closure.

When the closure, and therefore the valve, is opened, high velocity, inert gas is admitted to the space between the conical walls to direct the gas downwardly and radially into the poke hole to block the outward passage of noxious or volatile gas from the poke hole. The valve is closed when the closure is closed to shut off the flow of inert gas.

DETAILED DESCRIPTION OF THE INVENTION

Figure 1:
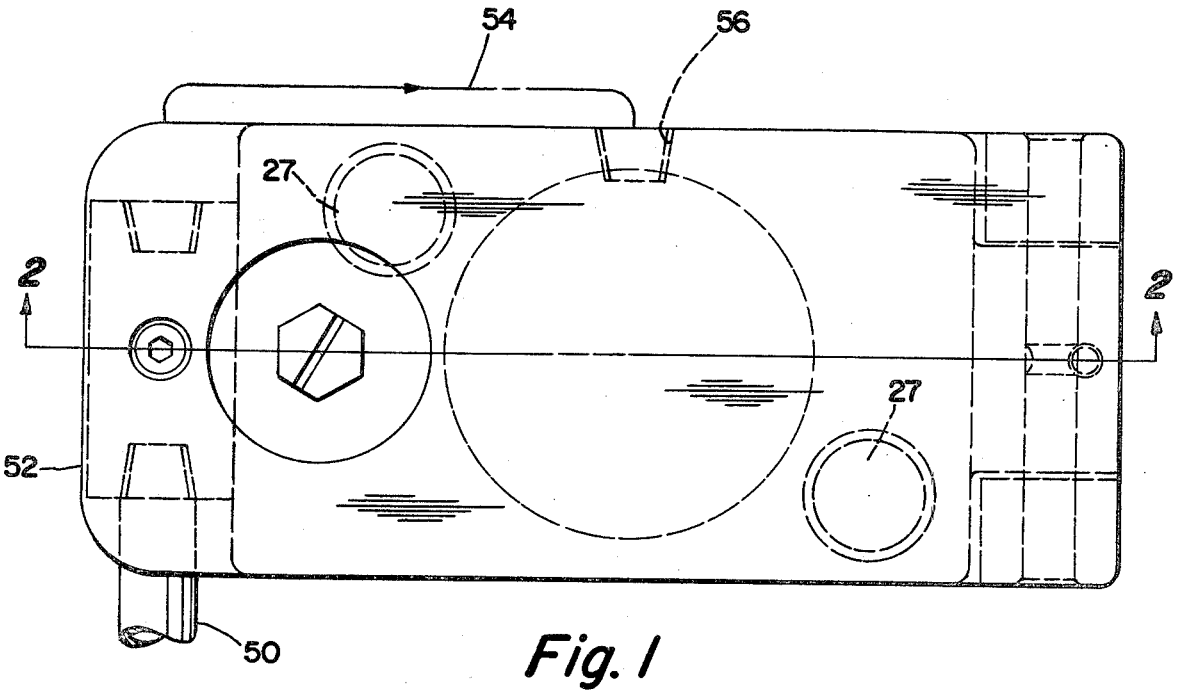
FIG. 1 is a plan view of a poke hole closure device in accordance with this invention.
Figure 2:
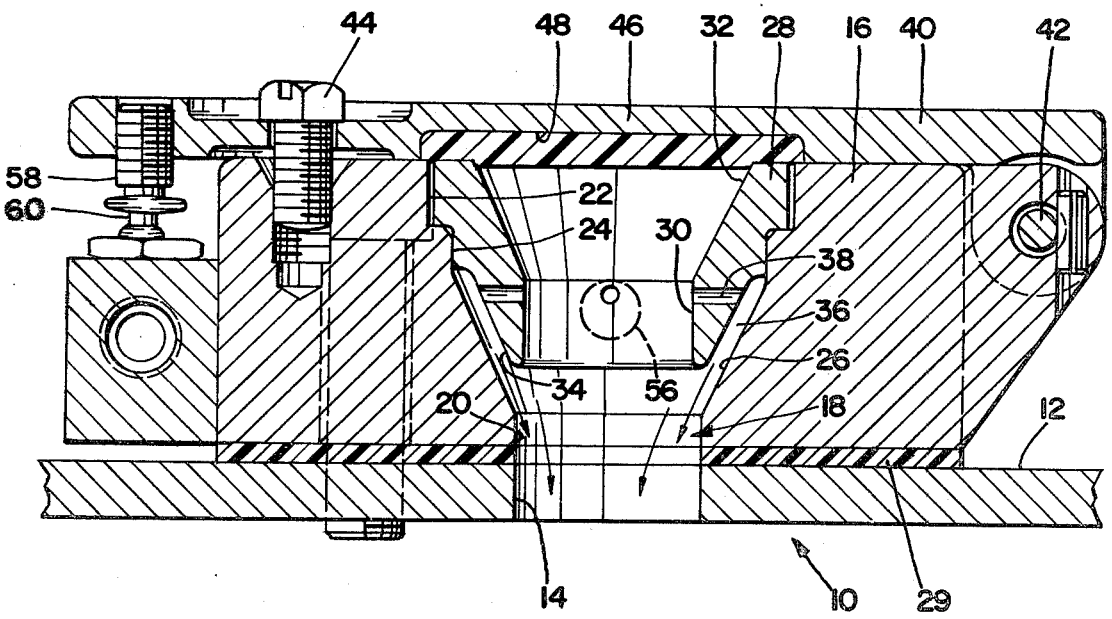
FIG. 2 is a cross sectional view, the plane of the section being indicated by the line 2—2 in FIG. 1.

Referring now to the drawing, there is illustrated a poke hole closure device 10 according to this invention. The closure device 10 is illustrated as being mounted on a top cover plate 12 of a water-jacketed gas producer.

The closure device is intended to alternately seal and permit access to a poke hole 14 provided in the plate 12.

The closure member 10 comprises a block 16 having an aperture 18 therethrough. The aperture 18 comprises a bore 20 at one end and counterbores 22 and 24 at the other end. An inner conical wall 26 joins the bore 20 and the counterbore 24. The block 16 is fastened to the plate 12 by bolts 27 and is insulated therefrom by an asbestos pad or gasket 29.

The aperture 18 is provided with a nozzle, which comprises an insert 28 having a bore 30 therein. The bore 30 flares conically outwardly to form a wall 32. The insert 28 is press-fitted in the counterbore 24 and has an outer conical wall 34 which is spaced from the conical wall 26 to form a conical chamber 36. A plurality of ports 38 extend between the conical chamber 36 and the bore 30.

The bore 30 and the aperture 18 are closed by a closure plate 40, which is hinged to the block 16 by a pin 42. In order to securely hold the closure plate 40 in a closed position during normal operations of the gas producer, a bolt 44 extends through the closure plate 40 and is threaded into the block 16. In order to seal the aperture 18, there is provided a silicone gasket 46 sealed within a recess 48.

A conduit 50 leading from a source of inert gas flows through a normally open valve 52, through a conduit 54, through a port 56, and into the conical chamber 36. Under normal operating conditions, the valve 52 is held closed by a button 58 carried by the closure 40, which engages a plunger 60 on the valve to hold the valve closed.

When the closure 40 is raised for a poking operation, the valve 52 is turned on and the inert gas is admitted to the conical chamber 36 under a high flow rate. The inert gas is directed downwardly and radially inwardly through the chamber 36, emerging as a converging conical jet toward the poke hole 14. The velocity and mass flow rate of the jet are such that its velocity pressure is greater than the static pressure of the producer gas and thus prevents its outward flow.

The ports 38 allow some of the high pressure gas to flow radially inward to provide a blanket of inert gas which is sucked downwardly by the jet action, preventing the entrainment of air. When the poke rod is inserted, the small clearance between the rod and the bore 30 increases the inert gas flow velocity, and thereby its action.

The inert gas can be any gas that does not contain free oxygen. Carbon dioxide is preferred because of its low cost, high molecular weight, and availability. If readily available, other gases, such as nitrogen or steam, may be employed.

While the invention has been described in connection with specific embodiments thereof, it is to be clearly understood that this is done only by way of example, and not as a limitation to the scope of the invention as set forth in the objects thereof and in the appended claims.

What is claimed is:

1. A poke hole closure assembly for a gas producer to minimize the escape of noxious or volatile gas from the producer during a poking operation, comprising closure means for a poke hole of a gas producer, said closure means comprising a block having an aperture therethrough, means attaching said block to a gas producer so that said aperture is in substantial alignment with a poke hole, a closure plate hinged to said block to block said aperture and poke hole during normal operating conditions and being openable to enable a poker to be inserted therethrough, and nozzle means responsive to the opening of said closure means to direct an inert gas into said poke hole, said nozzle means including passage means communicating with the interior of said aperture for conducting said inert gas to said aperture, said nozzle further including a hollow, conical insert mounted in said aperture, said insert having an opening therethrough to permit passage of said poker and having an outer conical wall spaced from an inner conical wall of said aperture, said passage means opening through said inner conical wall and into the space between said conical walls so that the inert gas will be directed downwardly and radially into said poke hole to block the outward passage of noxious or volatile gas from said poke hole when said closure plate is opened, means to prevent the entrainment of air in the downwardly and inwardly directed flow of inert gases comprising a plurality of ports extending through said insert from the space between said inner and outer conical walls to the opening through the insert to provide a blanket of inert gas which is sucked into the poke hole; to thereby prevent the entrainment of air.

2. A poke hole closure assembly for a gas producer to minimize the escape of noxious or volatile gas from the producer during a poking operation, comprising closure means for a poke hole of a gas producer, said closure means comprising a block having an aperture therethrough, means attaching said block to a gas producer so that said aperture is in substantial alignment with a poke hole, a closure plate hinged to said block to block said aperture during normal operating conditions and being openable to enable a poker to be inserted therethrough, nozzle means in said aperture for directing an inert gas into said poke hole, passage means including a valve means therein for delivering inert gas to said nozzle means, said valve means being operated to an "on" condition by opening said closure means and to an "off" condition by closing said closure means, said passage means communicating with the interior of said aperture for conducting said inert gas to said aperture, said nozzle further including a hollow conical insert mounted in said aperture, said insert having an opening therethrough to permit passage of said poker and having an outer conical wall spaced from an inner conical wall of said aperture, said passage means opening through said inner conical wall and into the space between said conical walls so that the inert gas will be directed downwardly and radially into said poke hole to block the outward passage of noxious or volatile gases from said poke hole when said closure plate is opened, means to prevent the entrainment of air in the downwardly and inwardly directed flow of inert gas comprising a plurality of ports extending through said insert from the space between said inner and outer conical walls to the opening through the insert to provide a blanket of inert gas which is sucked into the poke hole to thereby prevent the entrainment of air.

* * * * *